United States Patent [19]

Troebel et al.

[11] 4,392,036

[45] Jul. 5, 1983

[54] LOW-VOLTAGE PROTECTIVE CIRCUIT BREAKER WITH A FORKED LOCKING LEVER

[75] Inventors: Werner Troebel; Martin Böttcher, both of Berlin, Fed. Rep. of Germany

[73] Assignee: Siemens Aktiengesellschaft, Munich, Fed. Rep. of Germany

[21] Appl. No.: 297,769

[22] Filed: Aug. 31, 1981

[30] Foreign Application Priority Data

Aug. 29, 1980 [DE] Fed. Rep. of Germany ..... 3033213

[51] Int. Cl.[3] ..... H01H 9/20

[52] U.S. Cl. ..... 200/322; 200/153 G; 335/166

[58] Field of Search ..... 200/153 G, 321, 322, 200/DIG. 42, 67 PK; 335/166

[56] References Cited

U.S. PATENT DOCUMENTS

| | | | |
|---|---|---|---|
| 2,627,564 | 2/1953 | Ericson | 200/67 PK |
| 2,870,282 | 1/1959 | Brand | 200/67 PK |
| 3,621,189 | 11/1971 | Link | 200/153 G |
| 4,129,762 | 12/1978 | Bruchet | 200/DIG. 42 X |
| 4,165,453 | 8/1979 | Hennemann | 200/337 X |
| 4,368,444 | 1/1983 | Preuss et al. | 200/153 G X |

*Primary Examiner*—John W. Shepperd
*Assistant Examiner*—Ernest Cusick
*Attorney, Agent, or Firm*—Kenyon & Kenyon

[57] ABSTRACT

A low-voltage circuit breaker has a locking lever to prevent transfer of the circuit breaker handle entirely into its "off" position if the movable contact is blocked in its "on" position by being welded to the fixed contact. The locking lever is rotatably mounted on the control shaft, which is pivotally moved by a drive lever which is connected to the control shaft by a toggle lever system including two toggle levers and a toggle hinge pin joining them together. The fork arms embrace a working surface on the drive lever and the toggle hinge pin. The working surface and the hinge pin are spaced closer together than the arms when the circuit breaker handle is in its "on" position to allow only partial movement of the handle toward its "off" position unless the movable contact is free to move to its "off" position before the locking lever pivots to a position in which it engages both the working surface and the toggle hinge pin. The locking lever can be formed as a double lever with a connecting web.

6 Claims, 8 Drawing Figures

LOW-VOLTAGE PROTECTIVE CIRCUIT BREAKER WITH A FORKED LOCKING LEVER

BACKGROUND OF THE INVENTION

1. Field of the Invention

This invention relates to a low voltage protective circuit breaker with an actuating lever that can be moved by an operating handle and is connected by means of a drive spring and two toggle levers to a control shaft on which movable contacts for the circuit breaker are mounted. In particular, the invention relates to a locking lever mounted on the control shaft to prevent moving the handle into its "off" position if the movable contact is blocked in its "on" position so that it remains conductively engaged with the fixed contact.

2. The Prior Art

A protective circuit breaker generally similar to the type described herein is shown in DE-OS No. 25 08 220 in which a locking lever is permanently connected to a control shaft and cooperates with a hinged stop in such a manner that the drive lever and, thereby, the handle mounted on the drive lever, are prevented from being transferred into their "off" position whenever the movable contact is blocked in its "on" position, as, for instance, by being welded to the fixed contact. If, on the other hand, the contacts are not welded together and a normal interruption occurs, the resulting rotation of the control shaft and the corresponding rotation of the locking lever lifts a stop to release the drive lever. In both instances, the latching of the switching mechanism is first released by a release member connected to the drive lever.

Another known device shown in U.S. Pat. No. 4,165,453 for blocking the driving lever if the contacts are blocked comprises a two-armed locking lever supported on the toggle joint of the toggle levers so that one of the arms fits within the turns of a helical drive spring for the toggle levers, while the other lever arm cooperates with the joint pin that connects the toggle levers to the carrier of the movable contact. When that circuit breaker is switched off by hand, the toggle levers are always snapped through in the "off" direction before the engagement direction of the drive spring reaches dead center. Normally, the movable contacts would then be opened completely, but if the movable contacts were blocked so that they could not disengage from the fixed contacts, the driver lever could no longer be pivoted further in the "off" direction because of locking of one lever arm against the movable contact remaining in the "on" position.

OBJECTS AND SUMMARY OF THE INVENTION

It is one of the objects of the present invention to provide a simple structure to be incorporated in a circuit breaker to prevent the handle of the circuit breaker from moving to its "off" position when the movable contact is blocked in its "on" position and to transmit a large separation force to separate the movable and fixed contacts.

Another object of the invention is to utilize a locking lever mounted on a control shaft to provide a safe limit for the distance that a drive lever can move when the movable contacts are blocked in such a way as to cause them to maintain connection with the corresponding fixed contacts.

Further objects will become apparent from the following specification together with the drawings.

According to this invention, a circuit breaker is provided with a forked locking lever supported on a control shaft and rotatable with respect to that shaft. The arms of the forked lever embrace the toggle joint of the toggle levers as well as a working surface of the drive lever. The arms of the forked locking lever are arranged to provide a small amount of play corresponding to only a partial movement of the drive lever toward its "off" position. With this arrangement, any force applied during an attempt to switch off the circuit breaker while its movable contact was blocked, would be taken up by the locking lever, itself, which is braced against the control shaft. A particular advantage of this arrangement is that the locking lever engages the toggle joint with a force that is effective in the opening direction of the toggle joint as well as in the direction of the abutment of the toggle levers facing away from the movable contact. This design of the locking lever can be obtained by the shape of the curve of that part of the surface of one of the arms of the forked lever that cooperates with the toggle joint, and it permits relatively high separation forces that are not limited by pre-tension of the switching mechanism due to the drive spring.

As a rule, the points at which the locking lever engages the switching mechanism do not lie in one plane. However, the locking lever can be shaped in a way that makes it suitable for cooperation with these points of engagement by providing a fork arm that is slanted or offset so as to make contact with the working surface of the drive lever. A generally similarly shaped second fork arm is provided for making contact with the toggle joint pin of the toggle lever system. The length of the fork arm depends in part on the space that must be maintained for the possible movement of other components of the switching mechanism or for selectably usable accessories of the protective circuit breaker.

Instead of having one portion of one fork arm angled-off or offset, a corresponding shape of the drive lever could also be provided.

The play between the fork arms of the locking lever and the counter surfaces of the drive lever and the toggle joint can be made relatively large in the "on" direction, as opposed to the condition in which the contacts touch each other. This insures unimpeded closing and prevents damage to the surface of the locking lever that engages the toggle joint.

Control shafts for circuit breakers are customarily provided with a polygonal profile, which is usually square, and they consist of a metal core clad with an insulating material. The locking lever can be supported on that type of polygonal control shaft by means of a bearing body that has a cylindrical outer surface. In addition, the locking lever can be supported against canting or lateral displacement or both. As a result, the fork arms of the locking lever are always aligned with respect to the counter surfaces of the toggle joint and the drive lever, so that the required interaction is insured.

In principle, a single locking lever can be used if the drive lever is arranged in pairs, i.e., as a double lever. However, the forces produced can be controlled still better if two mirror-symmetrical locking levers, in connection with the paired drive lever, are provided so that each has its own support and abutment.

It is even better to arrange the locking lever as a double lever with two mirror-symmetrical branches and a crosspiece or web joining them. This eliminates the danger of canting, and the bearing of the locking lever on the control shaft is stressed in a more desirable way.

DETAILED DESCRIPTION OF THE INVENTION

Figure 1:
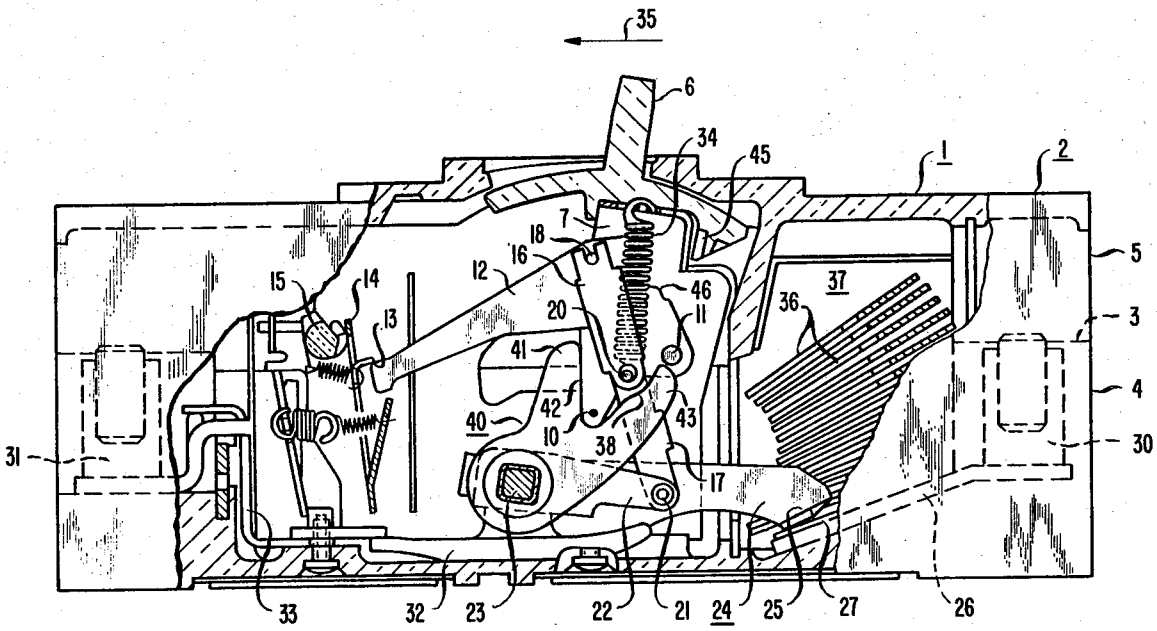
FIG. 1 is a side-elevational view of a circuit breaker according to this invention with parts of the outer housing of the circuit breaker broken away to show the interior structure.

FIG. 1 shows a low-voltage circuit breaker 1 of the type commonly referred to as a compact circuit breaker. It has a housing 2 made of insulating material and divided along a parting line 3 into a lower part 4 (according to the orientation of FIG. 1) and an upper part 5. An operating handle 6, which is used to switch the circuit breaker 1 on and off manually, extends from an opening in the part 5. The operating movement of the handle 6 is transmitted by means of a drive lever 7 pivoted about a stationary abutment 10. A main pawl 12 is pivoted on a stationary bearing 11 and has a projection 13 braced against a locking latch 14 when the pawl is in the "on" position, as shown. The locking latch 14 can be released, in a manner per se, by a release shaft 15 that can be pivoted by a well-known thermal or a magnetic tripping device (not shown). A detailed description of a release shaft of this type and other parts of a tripping device is contained in German Pat. No. 28 12 320.

The main pawl 12 supports a toggle lever system including levers 16 and 17. One end of the lever 16 engages a pin 18 on the main pawl 12 and can pivot about it. The levers are connected to each other by a toggle joint pin 20 and are connected by another joint pin 21 to a contact carrier 22. The latter is rigidly fastened onto a control shaft 23 rotatably supported in the lower part 4 of the housing 2 so that the shaft 23 and the carrier 22 pivot as a unit. A movable contact 24 provided with an overlay 25 is connected to the contact carrier 22 by the interposition of well-known contact pressure springs (not shown). The movable contact 24 is located opposite a stationary contact 26 that is also provided with a contact overlay 27. The current path of the protective circuit breaker 1 also comprises a terminal 30 connected to the stationary contact 26 and another terminal 31, which is at the opposite end of the housing 2 and is connected to the movable contact 24 by means of a flexible conductor 32 and a heater 33.

Figure 2:
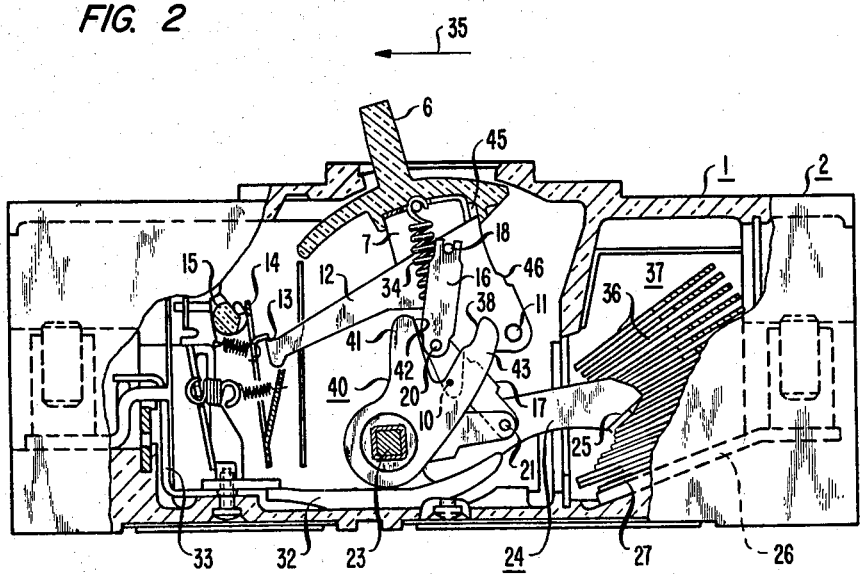
FIG. 2 is a side-elevational view of the circuit breaker of FIG. 1 showing the device in an open-circuit position produced by actuation of the operating handle.

In the "on" position, which is the position illustrated in FIG. 1, the toggle levers 16 and 17 assume their stretched position in response to the force of a drive spring 34 stretched between the the upper end of the drive lever 7 and the toggle joint pin 20. If the operating handle 6 is moved in the direction of the arrow 35, as shown in FIG. 2, the toggle levers are pivoted, or snapped, through, and the position of the main pawl 12 is unchanged. As a result, the contact carrier 22 is rotated counterclockwise by the control shaft 23, and the movable contact 24 is lifted off the stationary 26. Any developing switching arc is quenched by the quenching lamination 36 in the quenching chamber 37.

It must be assumed that the contact overlays 25 and 27 of the movable contact 24 and the stationary contact 26 can become welded together to some degree. This would lead to the locking of the movable contact 24 in the "on" position. To provide for that possibility, the protective circuit breaker 1 has a device that prevents the operating handle 6 from being moved into the "off" position in the direction of the arrow 35 when the movable contact is so locked. An essential component of this protective device is a forked locking lever 40 that is arranged on the control shaft 23 and is supported so that it can be rotated relative to the shaft 23. One arm 41 of the locking lever 40 cooperates with a working surface 42 of the drive lever 7, while another arm 43 cooperates with the toggle pin 20 of the toggle levers 16 and 17.

The locking lever 40 extends beyond the toggle joint of the levers 16 and 17 as well as beyond the drive lever 7 and has a certain amount of play between the toggle joint pin 20 and the fork arm 43, as shown in FIG. 1. Therefore, if an attempt is made to switch the protective circuit breaker 1 off when the movable contact 24 is locked, the locking lever 40 will first be taken along by engagement of the arm 41 with the working surface 42 of the drive lever 7, until the other arm 43 makes contact with the toggle joint pin 20 as a result of a certain amount of force on the operating handle 6. This causes the toggle levers 16 and 17 to be snapped through in the "off" direction, but further movement of the drive lever is prevented. As a result, the handle 6 cannot be transferred to its normal "off" position but can be moved only about half way.

The configuration of the arm 43 of the locking lever 40 must be carefully arranged so that no operational motion cycles within the circuit breaker are impeded and so that no interfering wear takes place. For this purpose, the surface 38 of the arm 43 opposite the toggle joint pin 20 is formed so that, when the movable contact 24 is switched on, a minimum amount of play between the toggle pin 20 and the working surface of the drive lever 7, on the one hand, and the arms 41 and 43, on the other hand, still exists.

The force that occurs when an attempt is made to switch the contact 24 to its "off" position at a time when the contacts 24 and 26 are locked together so that such movement of the contact 24 is blocked is substantially taken up by the locking lever 40, itself, so that its support on the control shaft 23 is stressed in compression. The control shaft can therefore be formed from a support body that consists of a suitable plastic material and has an internal channel that fits the profile of the control shaft. The external surface of the support body is a circularly cylindrical support surface for the locking lever 40. This support body can simultaneously be arranged to limit the axial play. The locking lever 40 not only transmits the force for operating the toggle lever system but also a force for separating the contacts 24 and 26 when they have been welded together. The latter force is not limited by pre-tension forces provided in the switching mechanism. In order to achieve this, the arm 43 of the locking lever 40 engages the toggle pin 20 with two force components that have different degrees of effectiveness. One component acts in the direction to cause the toggle levers 16 and 17 to snap through so as to unlatch the movable contact 24. The other component acts in the direction of the abutment pin 18 that drives the toggle lever 16 on the main pawl 12. With a corresponding amount of force at the operating handle 6, a separation force can thereby be exerted on the movable contacts 24 due to the snapping-through of the toggle levers 16 and 17. This separating force is braced by the pin 18 against the main pawl 12 which, in turn, rests againsts the locking strap 14.

Figure 3:
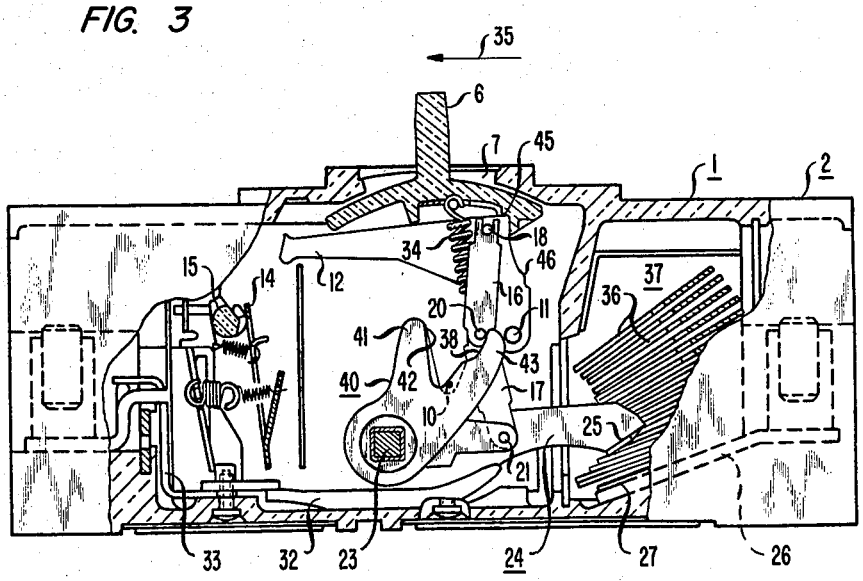
FIG. 3 is a side-elevational view of the circuit breaker of FIGS. 1 and 2 showing the device in an open-circuit position produced by tripping as a result of an overcurrent condition.
Figure 3:
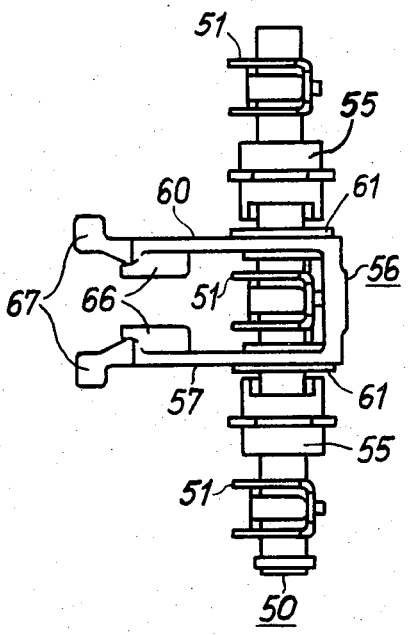
Figure 2:
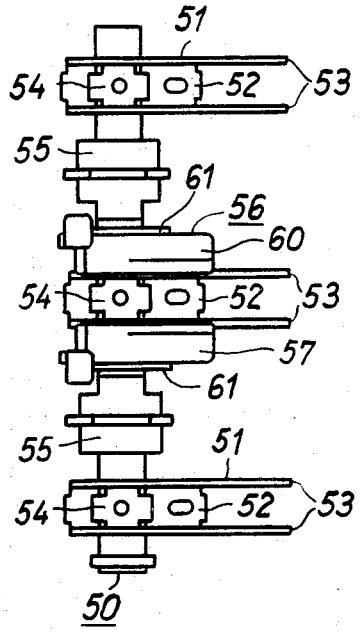

FIG. 3 shows the circuit breaker of FIGS. 1 and 2 in an open-circuit position as a result of overcurrent tripping. In response to leftward motion of the locking latch 12, projection 13 of the main pawl 12 is driven upward by operation of the drive spring 34. Drive spring 34 also pulls the movable contact upward to separate the electrical communication between overlays 25 and 27. The circuit breaker is reset by moving operating handle 6 to the "off" position, in the direction of arrow 35. This operation brings the mechanism into the positions shown in FIG. 2. The main pawl 12 is latched with locking latch 14 as it is driven downward by a reset push surface 45 of operating handle 6. Reset push surface 35 communicates with a pawl working surface 46 such that the main pawl 12 is rotated counterclockwise about the stationary bearing 11 as the operating handle 6 is moved to the "off" position. The circuit breaker may then be placed in the "on" position by moving the operating handle to the right, thereby achieving the position of FIG. 1.

Figure 4:
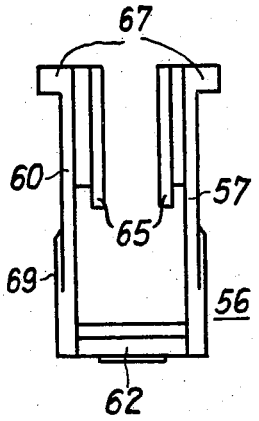
FIGS. 4 and 5 show a control shaft sub-assembly including carriers of movable contacts, as well as a locking lever.
Figure 5:
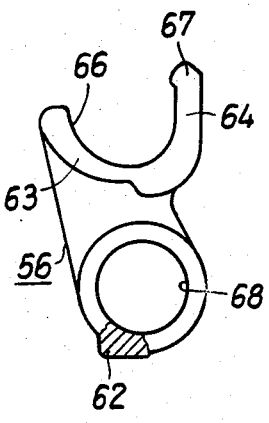

Details of the arrangement of the locking lever 40 on the control shaft 23 are shown in FIGS. 4 and 5. These figures show a small part of the structure, but they show it in more detail than FIGS. 1–3, and different reference numerals are used for the parts. One of these parts is a control shaft 50 that consists of a metal core with insulating plastic pressed all around it. The shaft has a square cross-section, and three contact carriers 51 are located on the shaft and are fastened side by side. Each of the carriers has a part 52 bent into a U-shaped configuration with arms 53 extending from the part closest to the shaft 50. A clamp 54 extends around the control shaft within each of the U-shaped parts 52 and is riveted thereto to provide a rigid connection between the control shaft and the respective contact carrier 51. Bearing members 55 are provided to support the control shaft 50 in the lower part 4 of the housing 2 (FIGS. 1–3) and are arranged movably between the contact carriers 51. The bearing members 55 are described in detail in DE-AS No. 27 57 696. The center contact carrier 51 is located between the legs of a locking lever 56 in the form of a double lever that is rotatable relative to the control shaft 50. For this purpose, branches 57 and 60 extend from the locking lever 56 and each branch is provided with an opening on a further bearing member 61 mounted on the control shaft 50. The bearing members 55, which are required nevertheless, can be used instead of the separate bearing members 61, provided thay are equipped with a corresponding extension in the direction of the branches 57 and 60.

Figure 6:
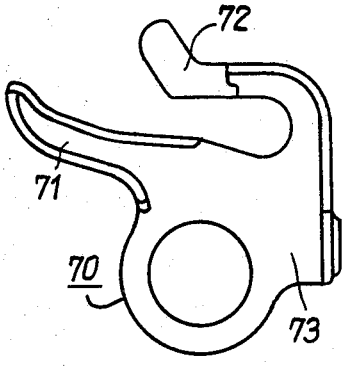
FIGS. 6 and 7 are two views of a locking lever in the form of a casting.
Figure 4:
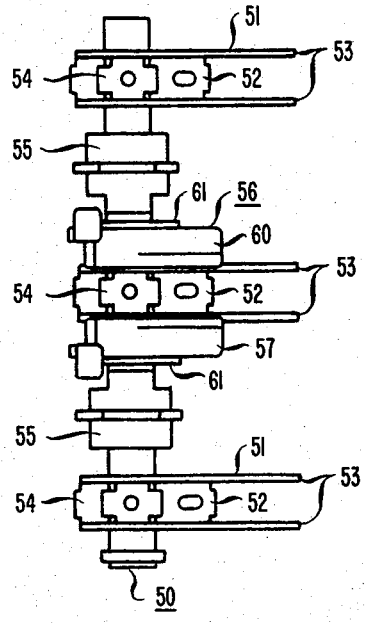
Figure 5:
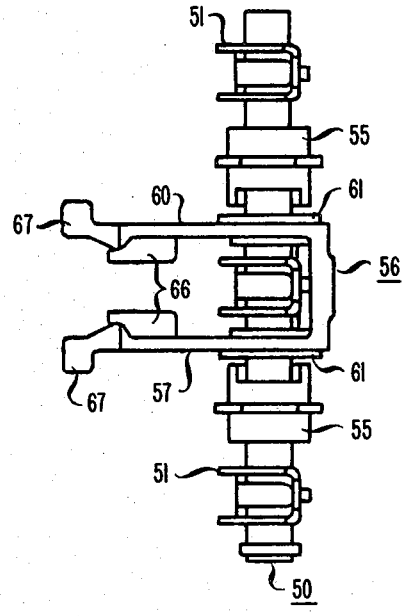
Figure 6:
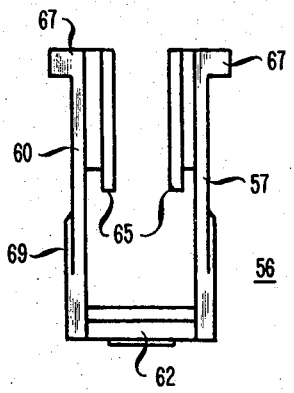
Figure 7:
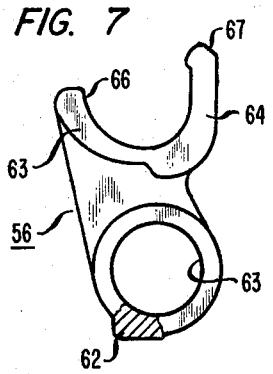

Further details of the locking lever 56 can be seen in FIGS. 6 and 7, in which the locking lever is shown enlarged relative to the size depicted in FIGS. 4 and 5. The locking lever 56 is produced as a casting so that the two branches 57 and 60, together with a cross-piece 62, are formed as a single part. The branches 57 and 60 are designed with mirror symmetry, and each of them has two arms 63 and 64. These arms have great stiffness to prevent their being spread by the forces in the form of the permissible manual force on the handle 6, such as can occur when attempt is made to switch the circuit breaker off when the movable contact 24 is blocked. The necessary strength of the arms 63 and 64 is provided by a reinforcement rib 65 at each of the two branches 57 and 60 to form a U-shaped profile with the outside wall of the branches. A curved region 66 is provided close to the end of the arm 63. This curved region cooperates with the toggle joint, which, as a rule, is the joint pin 20 shown in FIGS. 1–3 of the switch mechanism.

Figure 8:
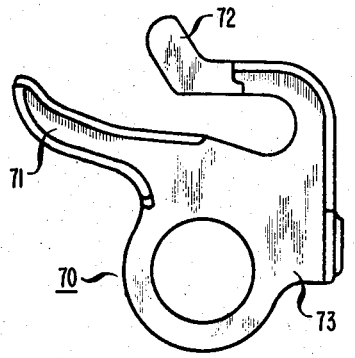
FIG. 8 is a side view of a modified form of locking lever with differently formed fork arms.

As has already been mentioned, the curved shape of this region is selected so that a minimal play exists during the switching-on at the instant of making contact and a somewhat larger amount of play, as indicated in FIGS. 1–3, exists in the completely closed condition. The opposite arm 64 has a rounded surface 67 at its end to rest against the drive lever 7 in FIGS. 1–3. Due to the offset form of the arms 63 and 64, the ends of these arms are correctly positioned relative to the counter surfaces of the switching mechanism. For this purpose, the surfaces 67 are provided at the sides of the branches facing away from each other, while the curved regions 66 are located on the sides of the branches facing each other (FIGS. 5 and 8). In the assembled condition of the circuit breaker, the branches of the drive lever 7, which are designed double or in pairs, are parallel to the legs 57 and 60 of the locking levers 66 on the outer side thereof. It is not necessary that the arm 64 be offset or angled outwardly if the drive lever 7 (FIG. 1) has a continuous curvature or an extension or the like.

The bearing lever 61 is in the form of a bushing, the inner surface of which fits the square profile of the control shaft 50 and is movable on the control shaft in the same manner as the bearing members 55. Externally, the bearing members 61 have a cylindrical support area for the inner opening 68 of the locking lever 66. A shoulder 69 is provided to limit the axial mobility of the locking lever 56 and can be part of the bearing members 61, or part of the locking lever 56 as shown in FIGS. 4 and 5.

A locking lever 70, which is also designed as a casting, is shown in FIG. 8. The shape of the arms 71 and 72 is different from the arms 63 and 64 in FIGS. 6 and 7 and is adapted to the different shape and motion of the switching mechanism of another protective circuit breaker. In addition, the locking lever 70 is in the form of a double lever with two parts arranged to be symmetrical with respect to each other and joined by a connecting web 73.

While the locking levers 56 and 70 are shown as castings, for instance chilled-mold castings, locking levers to accomplish the same purpose can also be fabricated of sheet metal by stamping and bending operations. Instead of double levers, individual levers or two individual levers can be used, and these can be made in various ways. The bearing members, or additional separate parts, can prevent lateral displacement or canting or both. With the double levers described, the danger of canting is eliminated so that it is only necessary to limit the lateral displacement.

Although the invention has been disclosed in terms of specific embodiments and applications, persons skilled in the art, in light of this teaching, can generate additional embodiments without departing from the spirit or exceeding the scope of the claims. Accordingly, it is to be understood that the drawings and descriptions in this disclosure are proffered to facilitate comprehension of the invention and should not be construed to limit the scope thereof.

What is claimed is:

1. A low-voltage circuit breaker comprising a drive lever, an operating handle to move the drive lever, a drive spring connected to the drive lever to be operated thereby, a toggle system including two toggle levers and a toggle joint connecting the levers together, a control shaft connected by the toggle lever system and the drive spring to the drive lever, a movable contact connected to the control shaft to be moved thereby, and a fixed contact in the path of movement of the movable contact to be engaged thereby, the invention comprising:

a locking lever pivotally mounted on the control shaft and movable between an "on" position and an "off" position; and a working surface on the drive lever, the locking lever comprising a first portion to be engaged by the working surface, whereby the working surface moves the locking lever toward its "off" position when the handle moves towards its "off" position, the locking lever comprising a second portion to be moved toward engagement with the toggle joint when the locking lever is moved by the working surface, the second portion of the locking lever being spaced from the toggle joint pin when the working surface of the drive lever first moves the locking lever, whereby there is play between the second portion of the locking lever and the toggle joint pin such that the locking lever can only be pivoted part way and allows only partial movement of the drive lever and the handle attached thereto unless the toggle joint pin moves out of the way of the second portion of the locking lever.

2. The invention according to claim 1 in which the locking lever comprises:

a first fork arm that engages the working surface of the drive lever; and a second fork arm angularly spaced from the first fork arm and positioned to move toward the toggle joint pin as the working surface of the drive lever moves the first fork arm toward its "off" position.

3. The invention according to claim 2 in which the fork arms are angularly displaced from each other by a distance greater than the distance between the working surface and the toggle joint pin when the circuit breaker is in its "on" position.

4. The invention according to claim 2 in which the drive lever comrpises two mirror-symmetrical locking lever portions, and each of the locking lever portions comprises bearing means and bracing means.

5. The invention as defined in claim 1 comprising, in addition, a bearing member mounted on the control shaft and having a circularly cylindrical outer surface, the locking lever being mounted rotatably on the circularly cylindrical outer surface of the bearing member and comprising bracing means to restrain undesired movement of the bearing member.

6. The invention as defined in claim 1 in which the locking lever is a double lever and comprises two mirror-symmetrical legs and a web connecting the legs together.

* * * * *